US012479628B2

(12) United States Patent
Guerry et al.

(10) Patent No.: US 12,479,628 B2
(45) Date of Patent: Nov. 25, 2025

(54) LEAKTIGHT CONTAINER HAVING A FLEXIBLE WALL COMPRISING A FIXING RING FOR JOINING IT TO A DEVICE ALLOWING THE CONTAINER TO BE REMOVABLY CONNECTED TO AN ENCLOSURE

(71) Applicant: ABC TRANSFER, Tours (FR)

(72) Inventors: Hervé Guerry, Tours (FR); Jean-Luc Schneider, Tours (FR)

(73) Assignee: ABC TRANSFER, Tours (FR)

( * ) Notice: Subject to any disclaimer, the term of this patent is extended or adjusted under 35 U.S.C. 154(b) by 0 days.

(21) Appl. No.: 17/999,303

(22) PCT Filed: May 21, 2021

(86) PCT No.: PCT/FR2021/050939
§ 371 (c)(1),
(2) Date: Nov. 18, 2022

(87) PCT Pub. No.: WO2021/234330
PCT Pub. Date: Nov. 25, 2021

(65) Prior Publication Data

US 2024/0375826 A1 Nov. 14, 2024

(30) Foreign Application Priority Data

May 21, 2020 (FR) ..... 2005407

(51) Int. Cl.
*B65D 35/24* (2006.01)
*B65D 35/02* (2006.01)

(52) U.S. Cl.
CPC ..... *B65D 35/245* (2013.01); *B65D 35/02* (2013.01)

(58) Field of Classification Search
CPC ..... B65D 35/02; B65D 35/245; B65D 35/12; B65D 35/44; B65B 67/1233
(Continued)

(56) References Cited

U.S. PATENT DOCUMENTS 2,476,446 A * 7/1949 Lindell ..... F16H 37/122 220/617
3,552,607 A * 1/1971 Edwards ..... B65D 47/122 222/566

(Continued)

FOREIGN PATENT DOCUMENTS

CN 1642656 7/2007
DE 08305356 6/1983

(Continued)

OTHER PUBLICATIONS

Office Action (original and translated) issued by the Japanese Patent Office for related Japanese case (2022-561534), mailed on Jan. 30, 2025.

*Primary Examiner* — Jeffrey R Allen
(74) *Attorney, Agent, or Firm* — McDonnell Boehnen Hulbert & Berghoff LLP

(57) ABSTRACT

The invention relates to a leaktight container (1) having a flexible wall comprising a bag (2) formed from a flexible film arranged so as to define a leaktight interior volume and a through-opening, and means for fixing the bag (2) to a connecting device (4) for connecting the container (1) in a leaktight manner to a sterile enclosure equipped with a complementary connecting device (4), said fixing means comprising a fixing ring (6) arranged so as to allow the connecting device (4) to be fixed reversibly to the bag (2), said ring being made up of two concentric annular parts fitted one in the other, the external annular part being dimensioned so as to be force-fitted around the internal annular part and to exert a radial stress thereon, the portion (Continued)

of film delimiting the through-opening being gripped between the two annular parts.

20 Claims, 5 Drawing Sheets

(58) Field of Classification Search
USPC ..... 220/495.08
See application file for complete search history.

(56) References Cited

U.S. PATENT DOCUMENTS

| | | | | | |
|---|---|---|---|---|---|
| 5,373,972 | A * | 12/1994 | Bystrom | ..... | B65D 47/18 222/476 |
| 5,425,400 | A | 6/1995 | Szatmary | | |
| 2012/0153610 | A1 | 6/2012 | Young | | |
| 2016/0236826 | A1 | 8/2016 | Hoskins | | |

FOREIGN PATENT DOCUMENTS

| | | |
|---|---|---|
| JP | 2015078003 | 4/2015 |
| WO | 2001036276 | 5/2001 |

* cited by examiner

LEAKTIGHT CONTAINER HAVING A FLEXIBLE WALL COMPRISING A FIXING RING FOR JOINING IT TO A DEVICE ALLOWING THE CONTAINER TO BE REMOVABLY CONNECTED TO AN ENCLOSURE

CROSS REFERENCE TO RELATED APPLICATION

This application is a U.S. National Phase of International Application No. PCT/FR2021/050939 filed May 21, 2021, which claims priority to French Patent Application No. FR2005407, filed May 21, 2020, both of which are incorporated by reference herein in their entirety.

TECHNICAL FIELD OF THE INVENTION

The invention relates to the field of containers which are intended to be connected in a leaktight manner to sterile enclosures in order to allow for the respective volumes thereof to be brought into communication without contact with said external environment.

The invention relates more particularly to a leaktight container having a flexible wall comprising a bag formed from a flexible plastics film arranged so as to define a leaktight interior volume and a through-opening, and means for fixing the bag to a connecting device which allows for leaktight connection of the container to a sterile enclosure equipped with a complementary connecting device.

The leaktight container having a flexible wall, according to the invention, is intended in particular, but not exclusively, for the transfer of dangerous products, such as some pharmaceutical, biotechnological, biological, chemical or radioactive products, the transfer of components such as corks, bottles, pistons, syringes, etc., for the transfer of environmental control devices such as culture medium supports, particular counters, etc., the transfer of cleaning systems, the transfer of liquids, powders, tools, the transfer of waste to the exterior of the enclosure, and/or the transfer of any element necessary for the production or for the maintenance of the production line.

PRIOR ART

In a known manner, the connection of a leaktight container having a flexible wall to a sterile enclosure for the transfer of products, without breaking the connection and the tightness, is achieved by means of two connecting devices, one provided on the container, the other provided on the enclosure. Each connecting device comprises a flange which defines, respectively, the through-opening in the interior volume of the container or of the enclosure, each of the through-openings being closed by a door. The flange and the door of the container are capable of being connected, respectively, to the flange and to the door of the enclosure by a bayonet connection, and detached from one another under the action of a rotational movement of the associated flange and door of the container with respect to the flange and door of the enclosure to which they are attached.

In the case of containers having a flexible wall formed from a flexible plastics film, the connecting device and the film are conventionally assembled by welding the film onto the flange. However, assembly by welding, for this type of container, is associated with a number of disadvantages.

Firstly, such assembly by welding does not ensure optimum tightness, and the presence of leakage points cannot be excluded. In the same way, it cannot ensure homogeneous welding at every point of the surface of the film. Moreover, since welding intrinsically changes the materials on which it is performed, it may be the case that the flexible film undergoes an alteration during the welding operation, which can thus create points of fragility in terms of resistance and tightness.

Secondly, the joining device has the disadvantage that it cannot be dismantled and therefore cannot be recycled.

Thirdly, the assembly by welding dictates the materials that are used for the flange to which the film is welded, and for the film itself.

The invention aims to overcome these problems by proposing a leaktight container having a flexible wall made of a flexible film that can be connected to a sterile enclosure, having improved mechanical strength and ensuring optimum tightness.

A further object of the invention is that of proposing a leaktight container having a flexible wall made of a flexible film that can be connected to a sterile enclosure, which can be produced simply and quickly, without the risk of deterioration of the film and contamination.

A further object of the invention is that of proposing a leaktight container having a flexible wall made of a flexible film that can be recycled.

OBJECT OF THE INVENTION

For this purpose, and according to a first aspect, the invention proposes a leaktight container comprising a bag formed from a flexible plastics film arranged so as to define a leaktight interior volume and comprising a through-opening, and means for fixing the bag to a connecting device which allows for leaktight connection of the container to a sterile enclosure equipped with a complementary connecting device, characterized in that the fixing means comprise a fixing ring arranged so as to allow the connecting device to be fixed reversibly to said bag, said fixing ring being made up of two concentric annular parts fitted one in the other in order to define, respectively, an internal annular part and an external annular part, the external annular part being dimensioned so as to be force-fitted around the internal annular part and to exert a radial stress thereon, the portion of film delimiting the through-opening being gripped between the external annular part and the internal annular part.

Advantageously, the internal annular part has an external peripheral face comprising at least two circumferential knurls which are arranged so as to define, together with the internal peripheral face of the external annular part, a compression zone of the portion of film gripped between the external and internal annular parts.

Advantageously, the knurls are spaced apart from one another so as to define a contact zone for contact with the internal face of the external annular part and defined by the knurls, which is subjected to a lower pressure stress than that exerted by the knurls on the external annular part.

Advantageously, the external annular part has a surface, with which the external peripheral face of the internal annular part bearing the knurls is in contact, which surface is flat.

It can be provided, according to a variant, for the internal peripheral face of the external annular part to comprise hollow imprints in each of which one knurl is positioned and retained under the radial stress of the external annular part exerted on the internal annular part.

According to another variant, the internal annular part has an external peripheral face comprising at least two knurls which are arranged so as to define, together with a knurl of the internal peripheral face of the external annular part, at least one annular zone which ensures both the fixing and the tightness of the annular parts with respect to one another.

Advantageously, the internal annular part is of a height that is greater than that of the external annular part.

Advantageously, the connecting device is borne by the internal annular part.

Advantageously, the external annular part is clip-mounted on the internal annular part.

Advantageously, the fixing ring is made of a bacteriostatic plastics material. Advantageously, the fixing ring can be dismantled.

Advantageously, the container comprises a connecting device which is arranged so as to connect the container, in a leaktight manner, to a sterile enclosure equipped with a complementary connecting device, ensuring sterile communication between the interior volume of said container and that of the enclosure, the connecting device comprising a flange which is fixed in a reversible and leaktight manner to the fixing ring, and delimiting, together with said fixing ring, the through-opening.

BRIEF DESCRIPTION OF THE FIGURES

Other features and advantages of the invention will become clear from the following detailed description of the invention, with reference to the accompanying drawings, in which.

For reasons of improved clarity, the identical or similar elements of the different embodiments are indicated by identical reference signs in all the figures.

DETAILED DESCRIPTION OF THE INVENTION

With respect to FIGS. 1 to 8, a leaktight container 1 having a flexible wall is described, said container comprising a bag 2 and a leaktight connecting device 4 arranged so as to allow for the connection of the bag 2 to a complementary connecting device of a sterile enclosure.

The bag 2 is formed of a flexible plastics film which is arranged so as to define a leaktight interior volume and comprising a through-opening which makes it possible to bring the interior volume into communication with the exterior of the bag.

Figure 1:
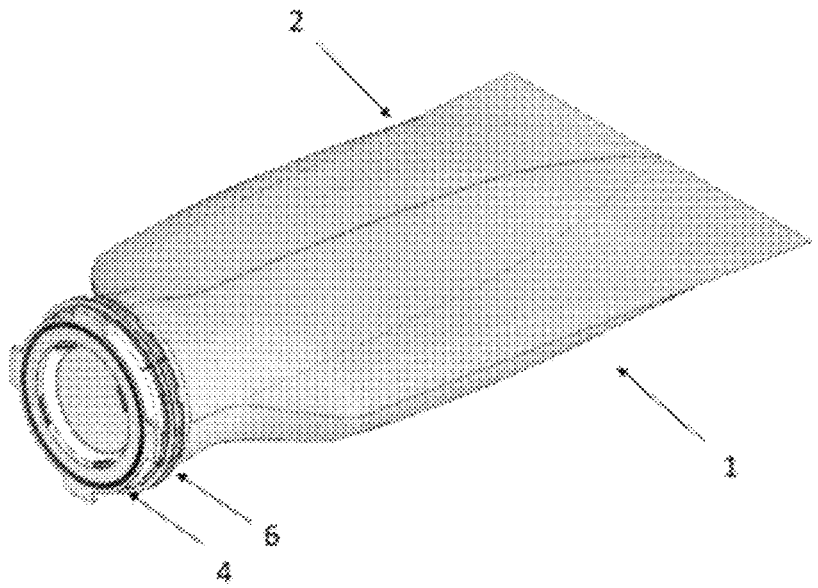
FIG. 1 is a schematic perspective view of a container according to the invention.
Figure 2:
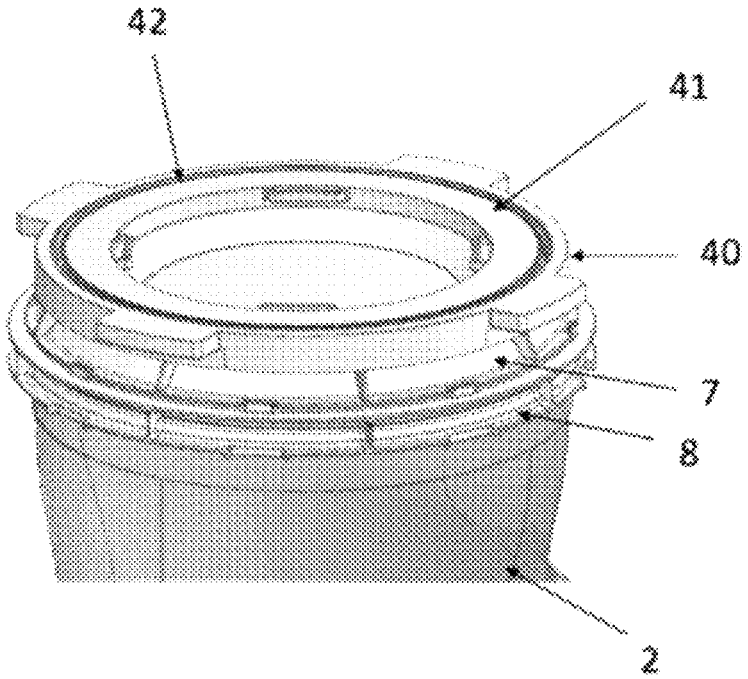
FIG. 2 is a detailed view of the container of FIG. 1.
Figure 3:
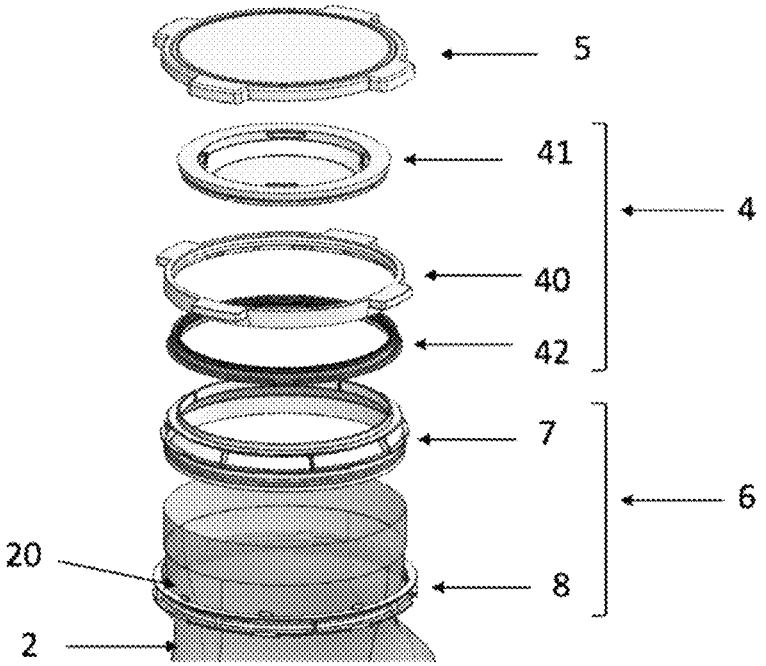
FIG. 3 is an exploded view of the part of the container shown in FIG. 2.
Figure 4:
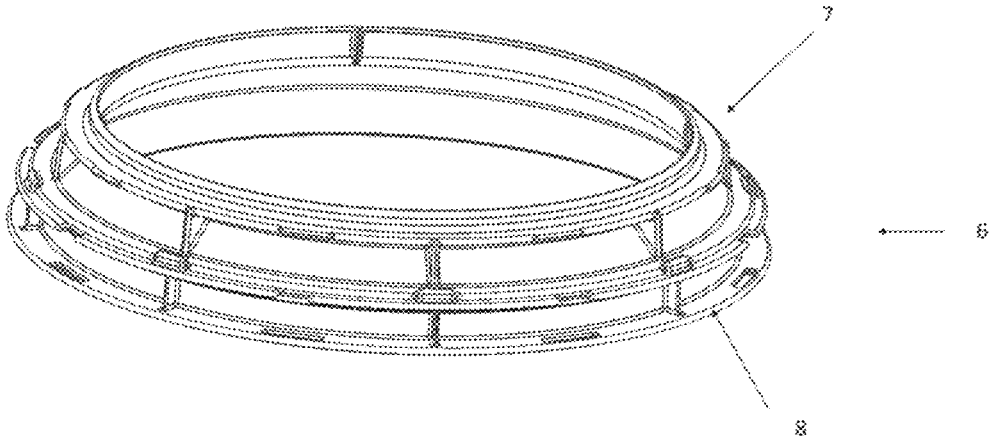
FIG. 4 is a view of the fixing ring of the container of FIG. 1.
Figure 5:
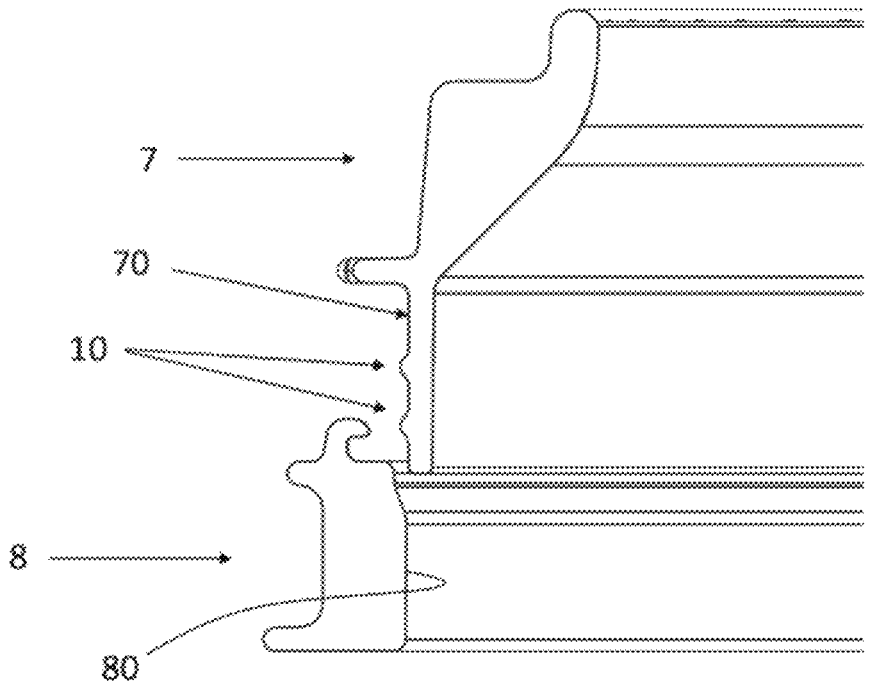
FIG. 5 is a partial cross section of consecutive parts of the fixing ring of FIG. 4 before assembly.
Figure 6:
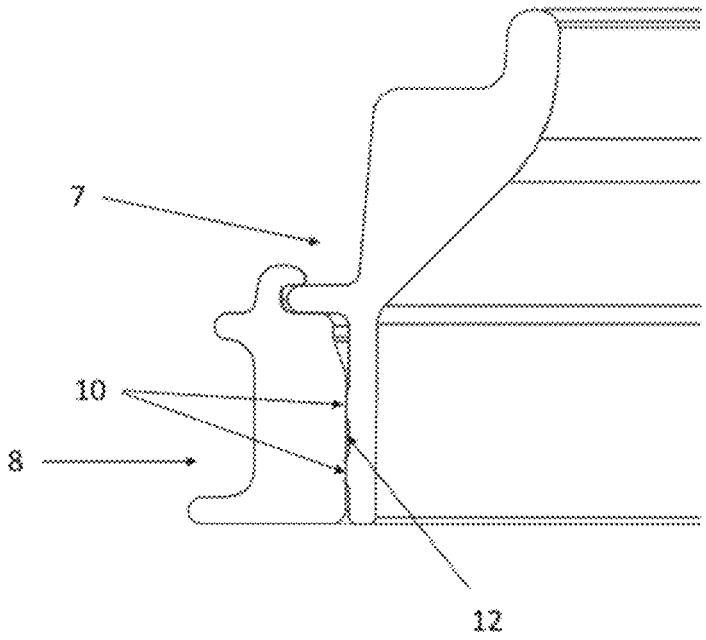
FIG. 6 is a partial cross section of consecutive parts of the fixing ring of FIG. 4 when assembled.
Figure 7:
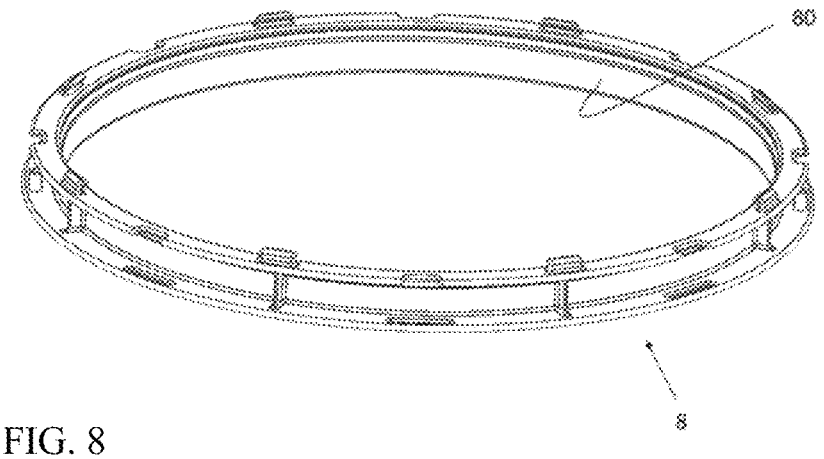
FIG. 7 is a view of the external annular part of the fixing ring of FIG. 4.
Figure 8:
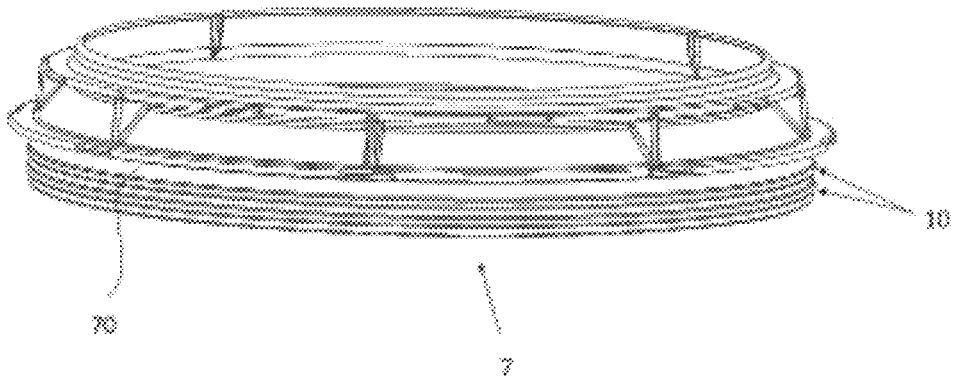
FIG. 8 is a view of the internal annular part of the fixing ring of the container of FIG. 1.

The connecting device 4 comprises a flange 40 which is connected to the bag 2, said flange defining the through-opening of the bag 2 when the body of the container is fixed to the flange. It further comprises a removable door 41 which is fixed to the flange 40 so as to close the through-opening. Advantageously, the flange 40 and the door 41 are fixed to one another by means of notches and lugs borne, respectively, by the flange 40 and the door 41. The container 1 further comprises an annular seal 42 that is borne by the flange (FIG. 3). It defines a door/flange seal of the connecting device 4.

The connection of the bag to the connecting device is made so as to ensure sterile communication between the interior volume of said container 1 and that of the enclosure.

The container 1 is advantageously provided with a protective cover 5 of the connecting device. An example of a protective cover is shown in FIG. 3. This is placed opposite the door 41 of the connecting device and is clip-mounted in a force-fitted manner on the lugs of the flange 40.

According to the invention, the container 1 comprises a fixing ring 6 which allows for leaktight fixing of the bag 2 to the connecting device 4 without the need to resort to welding. As will be described in the following, the fixing ring 6 is arranged so as to allow for reversible fixing of the connecting device 4 to the bag 2, making the connecting device such that it can be dismantled by nature. The fixing ring 6 is arranged together with the bag 2 so as to define the through-opening.

The fixing ring 6 according to the invention is made of two concentric annular parts which are fitted into one another. The parts define an annular part referred to as internal 7 and an annular part referred to as external 8. Advantageously, the external annular part 8 is clip-mounted on the internal annular part 7. The fixing ring 6 is advantageously made of a bacteriostatic plastics material, and preferably polyphenylene oxide.

The external annular part 8 is dimensioned so to be force-fitted around the internal annular part 7 and to exert a radial stress thereon, the portion of film 20 delimiting the through-opening being gripped between the external annular part 8 and the internal annular part 7. The internal annular part 7, in turn, is dimensioned so as to allow for easy assembly of the bag 2 on said part while avoiding the formation of folds in the bag 2 during force-mounting of the external annular part.

Advantageously, the internal annular part 7 is of a height that is greater than that of the external annular part 6. Thus, when the two annular parts 7, 8 are assembled with one another, the internal annular part 7 extends beyond the external annular part 8. As shown, the fixing ring 6 is mounted on the plastics film, the portion of the internal annular part 7 which extends beyond the external annular part 8 being oriented on the side opposite the interior of the bag 2. This arrangement of the fixing ring 6 has the advantage of preventing the need for handling inside the bag during assembly of the fixing ring 6 and of the bag 2. Entry of particles and/or microorganisms is thus prevented and the bag 2 is kept clean. The connecting device 4, in turn, is borne by the portion of the internal annular part 7 extending beyond the external annular part 6.

Finally, in order to ensure that the film is held gripped between the two annular parts 7, 8, on the one hand, and the tightness of the fixing ring 6 with the gripped bag 2, on the other hand, the internal annular part 7 has an external peripheral face 70 provided with circumferential knurls 10 which are arranged so as to define, together with the internal peripheral face 80 of the external annular part 8, which is flat, a compression zone of the portion of film 20 gripped between the two annular parts. In the embodiment shown, the internal annular part 7 comprises two knurls 10 extending over the entire circumference of the external peripheral face 70 of said part. It is of course obvious that a different number of knurls 10 can be provided without departing from the scope of the invention. In the example shown, the knurls have a similar profile and similar dimensions.

Placed against the internal face of the external annular part 8 and exerting a radial stress on the internal peripheral face 80 of the external annular part 8 in reaction to the radial stress exerted thereby, the knurls ensure the function of a seal between the body of the container and the fixing ring when the two annular parts are fitted together.

Advantageously, the knurls 10 are spaced apart from one another so as to define an inter-knurl zone which is subjected to a lower pressure stress than that exerted by the knurls 10 on the external annular part 8. This thus makes it possible, in combination with the two knurls borne by the internal annular part 7, to reinforce the tightness.

Figure 9:
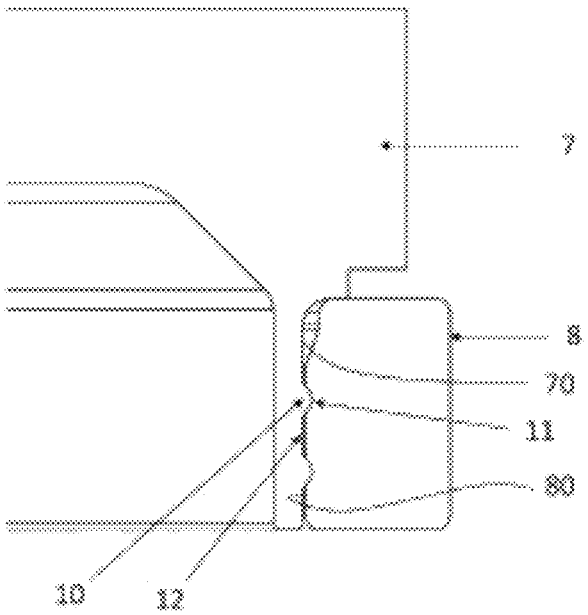
FIG. 9 is a partial cross section of a variant of the fixing ring.

FIG. 9 shows a second variant of the fixing ring 6. In this variant, the external annular part 8 comprises two circular hollow imprints 11 extending over the entire circumference of the internal peripheral face 80. As shown in FIG. 9, the external annular part 8 is fitted on the internal annular part 7 such that each knurl 10 is engaged in one hollow imprint 11. Thus, during clipping of the external annular part 8 onto the internal annular part 7, the knurls 10 crush the portion of film 20 of the bag in the region of the hollow imprint 11, thus ensuring improved gripping of the film. It is of course obvious that the number of hollow imprints 11 made on the internal peripheral face 80 of the external annular part 8 will be at least equal to the number of knurls 10 provided on the internal annular part 7. As above, the knurls 10 are arranged, together with the hollow imprints 11, so as to define a zone which is subjected to a lower pressure stress than that exerted by the knurls 10 on the external annular part 8.

Figure 10:
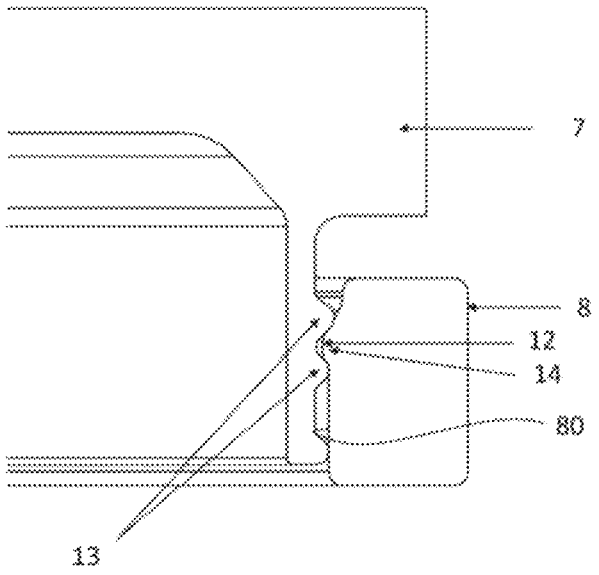
FIG. 10 is a partial cross section of another variant of the fixing ring.

FIG. 10 shows another variant of the fixing ring 6. In this variant, the external peripheral face 70 of the internal annular part 7 and the internal peripheral face 80 of the external annular part 8 comprise, respectively, knurls 13, 14. Said knurls are arranged so as to define an annular zone which ensures both the clipping of the annular parts to one another and the tightness between the bag and the annular parts of the fixing ring 6. In the variant shown, the knurls have non-identical profiles. These are configured so as to maintain the inter-knurl zone of low pressure as in the embodiments described above, and thus improve the tightness of the ring/film assembly.

On account of the arrangement of the elements from which it is made up, the container 1 is assembled by clipping the elements forming it. Thus, the internal annular part 7 is placed inside the bag 2, in the region of the through-opening thereof. The external annular part is then engaged around the bag 2, which extends between the internal annular part 7 and the external annular part 8, until it is force-fitted around the internal annular part 7. Once the external annular part 8 is force-fitted on the internal annular part 7, with the portion of film 20 defining the opening gripped between said parts (FIGS. 1 to 8), or indeed force-mounted until the parts clip together (FIGS. 9 and 10), the connecting device is clipped on the upper part of the internal annular part (free part of the internal annular part). Advantageously, the clipping together of the constituent parts is reversible. The ring can thus be dismantled from the container. In the same way, the clipping of the connecting device onto the ring is reversible. The connecting device can thus also be dismantled.

The bag 2 and the connecting device 4 are advantageously made of a bacteriostatic material. The seals 8 and 13 are made of a silicone material or other materials which minimize remanence phenomena. It can also be provided for the seals to be made of a bacteriostatic material.

The invention is described above by way of example. It will be understood that a person skilled in the art is able to implement different variants of the invention, without in any way departing from the scope of the invention.

The invention claimed is:

1. A leaktight container having a flexible wall comprising:

a bag formed from a flexible plastics film arranged so as to define a leaktight interior volume and comprising a through-opening, a connecting device which allows for leaktight connection of the leaktight container to a sterile enclosure equipped with a complementary connecting device, said connecting device comprising a flange, and means for fixing the bag to the flange;

wherein the fixing means comprise a fixing ring arranged so as to allow the connecting device to be fixed reversibly to said bag, said fixing ring being made up of two concentric annular parts dissociated from the flange, said two concentric annular parts being fitted one in the other in order to define, respectively, an internal annular part on which the flange is clip mounted in a reversible manner and an external annular part that is clip mounted on the internal annular part, the external annular part being dimensioned so as to be force-fitted around the internal annular part and to exert a radial stress thereon, a portion of film delimiting the through-opening being gripped between the external annular part and the internal annular part.

2. The leaktight container having a flexible wall according to claim 1, wherein the internal annular part has an external peripheral face comprising at least two circumferential knurls which are arranged so as to define, together with an internal peripheral face of the external annular part, a compression zone of the portion of film gripped between the external and internal annular parts.

3. The leaktight container having a flexible wall according to claim 2, wherein the external annular part has a surface which surface is flat, with which the external peripheral face of the internal annular part having the at least two circumferential knurls is in contact through the film.

4. The leaktight container having a flexible wall according to claim 2, wherein the internal peripheral face of the external annular part comprises hollow imprints in each of which one of the knurls is positioned and retained under the radial stress of the external annular part exerted on the internal annular part.

5. The leaktight container having a flexible wall according to claim 1, wherein the internal annular part has an external peripheral face comprising at least two knurls which are arranged so as to define, together with a knurl of the internal peripheral face of the external annular part, at least one annular zone which ensures both the fixing and the tightness of the annular parts with respect to one another.

6. The leaktight container having a flexible wall according to claim 2, wherein the knurls of the internal annular part are spaced apart from one another so as to define a contact zone for contact with the internal face of the external annular part and delimited by the knurls, which zone is subjected to a lower pressure stress than that exerted by said knurls on the external annular part.

7. The leaktight container having a flexible wall according to claim 1, wherein the internal annular part is of a height that is greater than that of the external annular part.

8. The leaktight container having a flexible wall according to claim 1, wherein the connecting device is borne by the internal annular part.

9. The leaktight container having a flexible wall according to claim 1, wherein the external annular part is clip-mounted on the internal annular part.

10. The leaktight container having a flexible wall according to claim 1, wherein the fixing ring is made of a bacteriostatic plastics material.

11. The leaktight container having a flexible wall according to claim 1, wherein the leaktight container comprises a connecting device which is arranged so as to connect the container, in a leaktight manner, to a sterile enclosure equipped with a complementary connecting device, ensuring sterile communication between the interior volume of said container and that of the enclosure, the connecting device comprising a flange which is fixed in a reversible and leaktight manner to the fixing ring, and delimiting, together with said fixing ring, the through-opening.

12. The leaktight container having a flexible wall according to claim 1, wherein the fixing ring can be dismantled.

13. The leaktight container having a flexible wall according to claim 2, wherein the knurls of the internal annular part are spaced apart from one another so as to define a contact zone for contact with the internal face of the external annular part and delimited by the knurls, which zone is subjected to a lower pressure stress than that exerted by said knurls on the external annular part.

14. The leaktight container having a flexible wall according to claim 5, wherein the knurls of the internal annular part are spaced apart from one another so as to define a contact zone for contact with the internal face of the external annular part and delimited by the knurls, which zone is subjected to a lower pressure stress than that exerted by said knurls on the external annular part.

15. The leaktight container having a flexible wall according to claim 2, wherein the internal annular part is of a height that is greater than that of the external annular part.

16. The leaktight container having a flexible wall according to claim 3, wherein the internal annular part is of a height that is greater than that of the external annular part.

17. The leaktight container having a flexible wall according to claim 4, wherein the internal annular part is of a height that is greater than that of the external annular part.

18. The leaktight container having a flexible wall according to claim 5, wherein the internal annular part is of a height that is greater than that of the external annular part.

19. The leaktight container having a flexible wall according to claim 2, wherein the leaktight container comprises a connecting device which is arranged so as to connect the container, in a leaktight manner, to a sterile enclosure equipped with a complementary connecting device, ensuring sterile communication between the interior volume of said container and that of the enclosure, the connecting device comprising a flange which is fixed in a reversible and leaktight manner to the fixing ring, and delimiting, together with said fixing ring, the through-opening.

20. The leaktight container having a flexible wall according to claim 5, wherein the leaktight container comprises a connecting device which is arranged so as to connect the container, in a leaktight manner, to a sterile enclosure equipped with a complementary connecting device, ensuring sterile communication between the interior volume of said container and that of the enclosure, the connecting device comprising a flange which is fixed in a reversible and leaktight manner to the fixing ring, and delimiting, together with said fixing ring, the through-opening.

* * * * *